US007083252B2

(12) United States Patent
Yokoyama et al.

(10) Patent No.: US 7,083,252 B2
(45) Date of Patent: Aug. 1, 2006

(54) INK JET PRINTER WITH ULTRAVIOLET CURABLE INK, ULTRAVIOLET IRRADIATION DEVICE, AND MAINTENANCE STATION WITH ULTRAVIOLET IRRADIATION MASKING

(75) Inventors: Takeshi Yokoyama, Hachioji (JP); Kouichi Kumamoto, Hachioji (JP); Satoshi Nishino, Hachioji (JP)

(73) Assignee: Konica Minolta Medical & Graphics, Inc., Tokyo (JP)

( * ) Notice: Subject to any disclaimer, the term of this patent is extended or adjusted under 35 U.S.C. 154(b) by 281 days.

(21) Appl. No.: 10/825,554

(22) Filed: Apr. 14, 2004

(65) Prior Publication Data

US 2004/0223028 A1 Nov. 11, 2004

(30) Foreign Application Priority Data

Apr. 18, 2003 (JP) ..... 2003-114590
Mar. 12, 2004 (JP) ..... 2004-071250

(51) Int. Cl.
*B41J 2/165* (2006.01)

(52) U.S. Cl. ..... 347/23

(58) Field of Classification Search ..... 347/23
See application file for complete search history.

(56) References Cited

U.S. PATENT DOCUMENTS 7,009,630 B1 * 3/2006 Finger et al. ..... 347/212
2002/0005870 A1 1/2002 Codos et al.
2002/0140794 A1 * 10/2002 Asano et al. ..... 347/102
2003/0011670 A1 * 1/2003 Shirakawa ..... 347/102
2003/0043246 A1 3/2003 Codos
2003/0189609 A1 * 10/2003 Ishikawa ..... 347/11
2004/0021726 A1 2/2004 Obertegger et al.
2004/0179079 A1 * 9/2004 Yokoyama ..... 347/102

FOREIGN PATENT DOCUMENTS

JP 60-132767 A 7/1985

* cited by examiner

*Primary Examiner*—K. Feggins
*Assistant Examiner*—Rene Garcia, Jr.
(74) *Attorney, Agent, or Firm*—Frishauf, Holtz, Goodman & Chick, P.C.

(57) ABSTRACT

An ink jet printer includes a carriage having a recording head for jetting ultraviolet curable ink and an ultraviolet irradiating device for curing an ink jetted on the recording medium with irradiation of ultraviolet rays such that an image is formed by scanning the carriage; and a maintenance unit for performing maintenance on the recording head at predetermined timing. It also includes a control section for controlling the maintenance unit so as to be converted to a masking state which becomes a head maintenance disabling state when an image is formed, and for controlling the maintenance unit so as to be converted to a non-masking state which becomes a head maintenance enabling state after securing a non-irradiating state in which the ultraviolet rays are not irradiated on the maintenance unit, by a function provided by a unit other than the maintenance unit when the head maintenance is performed.

20 Claims, 7 Drawing Sheets

INK JET PRINTER WITH ULTRAVIOLET CURABLE INK, ULTRAVIOLET IRRADIATION DEVICE, AND MAINTENANCE STATION WITH ULTRAVIOLET IRRADIATION MASKING

BACKGROUND OF THE INVENTION

1. Field of the Invention

The invention relates to an ink jet printer, and more particularly to an ink jet printer for forming an image on a recording medium by irradiation of ultraviolet rays after jetting ultraviolet curable ink.

2. Description of the Related Art

Recently, an ink jet printer that is an image recording apparatus adopting an ink jet recording method, has been widely used, because it can simply produce images at a low cost, compared with methods needing plate making such as a gravure printing method and a flexography printing method.

In a field where ink jet printers are used for recording images on products or wrapped products, non-ink-absorptive material, such as resin and metal, is frequently used for product itself or for wrapping products. As an ink jet printer for fixing ink on such non-ink absorptive material as a recording medium, there has been known such an ink jet printer that uses ultraviolet curable ink (refer, for example, JP-Tokukaisho 60-132767).

The ink jet printer using ultraviolet curable ink usually irradiates ultraviolet curable ink jetted on the recording medium to cure the ultraviolet curable ink for fixing it on the recording medium. At this time, it is preferable to irradiate ultraviolet rays as soon as possible after the impact of the ultraviolet curable ink, because, if it takes time to irradiate ultraviolet rays after the impact of the ultraviolet curable ink on the recording medium, such problems remarkably arise in expansion of a dot diameter of ink jetted on the recording medium, bleeding of ink between contiguous dots, and soaking of the ink into the recording medium.

A serial type ink jet printer generally records an image by jetting the ink from the jet openings of recording heads with the heads mounted on a carriage moving in a scanning direction. For avoiding the above-mentioned problems, the ink jet printer is usually provided with an ultraviolet irradiating device at downstream side of the recording heads in the scanning direction on the carriage so that the irradiating device can move together with the recording heads on the carriage. With this structure, the ultraviolet rays can be irradiated to the ink jetted from the heads just after the impact on the recording medium, thereby avoiding the problems described above.

The ink jet printer described above usually performs maintenance on the recording heads so as to recover from clogging at jet openings due to increase of ink viscosity or adhered ink, or clogging inside ink flow channels due to bubbles or contaminants, or to fill the recording heads with ink.

The above-described ink jet printer has a maintenance unit disposed at a predetermined maintenance region within a carriage scanning area for performing the head maintenance. Therefore, during image forming when the head maintenance is not needed, the carriage sometimes comes into the maintenance region and the ultraviolet irradiating device irradiates the maintenance unit.

Irradiation of ultraviolet rays on the maintenance unit is possible to cause deterioration of component parts such as an absorbing device and a wiping device constructing the maintenance unit. Further, the ultraviolet curable ink sticking to the component parts, for example, the absorbing device and the wiping device of the maintenance unit is cured by the irradiation of ultraviolet rays, which may reduce head maintenance performance, leading to unsuccessful head maintenance.

SUMMARY OF THE INVENTION

An object of the present invention is to provide an ink jet printer capable of performing excellent head maintenance, protecting a maintenance unit from irradiation of ultraviolet rays irradiated from an ultraviolet irradiating device.

In order to solve the above problem, in accordance with the first aspect of the present invention, an ink jet printer of the present invention comprises:

a recording head for jetting ultraviolet curable ink on a recording medium;

an ultraviolet irradiating device for curing the ink jetted on the recording medium with irradiation of the ultraviolet rays;

a carriage for scanning to form an image on the recording medium, the carriage having the recording head and the ultraviolet irradiating device;

a maintenance unit for performing maintenance on the recording head at a predetermined timing, the maintenance unit having a function switchable between a masking state in which the ultraviolet rays are masked and a non-masking state in which the ultraviolet rays are not masked, the masking state becoming a head maintenance disabling state in which head maintenance is not allowed, and the non-masking state becoming a head maintenance enabling state in which the head maintenance is allowed; and a control section for controlling the maintenance unit so as to be converted to the masking state which becomes the head maintenance disabling state when an image is formed, and for controlling the maintenance unit so as to be converted to the non-masking state which becomes the head maintenance enabling state after securing a non-irradiating state in which the ultraviolet rays irradiated from the ultraviolet irradiating device are not irradiated on the maintenance unit, by a function provided by a unit other than the maintenance unit when the head maintenance is performed.

By use of the ink jet printer of the present invention, the maintenance unit has a function switchable between a masking state in which the ultraviolet rays are masked and a non-masking state in which the ultraviolet rays are not masked, the masking state becoming a head maintenance disabling state in which head maintenance is not allowed, and the non-masking state becoming a head maintenance enabling state in which the head maintenance is allowed, and a control section is provided for controlling the maintenance unit so as to be converted to the masking state which becomes the head maintenance disabling state when an image is formed, and for controlling the maintenance unit so as to be converted to the non-masking state which becomes the head maintenance enabling state after securing a non-irradiating state in which the ultraviolet rays irradiated from the ultraviolet irradiating device are not irradiated on the maintenance unit, by a function provided by a unit other than the maintenance unit when the head maintenance is performed, to thereby protect the maintenance unit from irradiation of ultraviolet rays. Especially, when the maintenance unit is brought into the masking state in which the ultraviolet rays are masked in the invention, the ultraviolet rays are not irradiated over the maintenance unit to thereby mask all component parts such as the absorbing device having the absorbing cap for recovering the clogging by absorbing the ink with the jet openings closed and the wiping device for removing the ink adhered on the jetting surface.

Therefore, this structure prevents the maintenance unit from having defects, such as deterioration of its constructing parts due to irradiation of ultraviolet rays and reduction of maintenance performance due to curing of the ultraviolet curable ink adhered to the unit by irradiation of ultraviolet rays, to thereby allow the excellent head maintenance. Especially, all component parts such as the absorbing device having the absorbing cap for recovering the clogging by absorbing the ink with the jet openings closed and the wiping device for removing the ink adhered on the jetting surface may be masked to thereby prevent various defects such as reduction of closing performance of the absorbing caps of the absorbing device due to deterioration of the absorbing device and curing of the ink of the absorbing device and reduction of wiping performance for ink due to deterioration of the wiping device and curing of the ink of the wiping device.

In this case, it is preferable that the maintenance unit has a masking blade at a side facing the ultraviolet irradiating device, the masking blade being movable between a masking position in which the ultraviolet rays irradiated from the ultraviolet irradiating device are masked and an evacuating position in which the ultraviolet rays are not masked, and the control section controls the maintenance unit so as to be converted to the masking state which becomes the head maintenance disabling state when the image is formed, by moving the masking blade to the masking position, and controls the maintenance unit so as to be converted to the non-masking state which becomes the head maintenance enabling state, by moving the masking blade to the evacuating position after securing the non-irradiating state in which the ultraviolet rays irradiated from the ultraviolet irradiating device are not irradiated on the maintenance unit, by the function provided by the unit other than the maintenance unit when the head maintenance is performed.

By use of such ink jet printer, the maintenance unit has a masking blade at a side facing the ultraviolet irradiating device, the masking blade being movable between a masking position in which the ultraviolet rays irradiated from the ultraviolet irradiating device are masked and an evacuating position in which the ultraviolet rays are not masked, and the control section controls the maintenance unit so as to be converted to the masking state which becomes the head maintenance disabling state when the image is formed, by moving the masking blade to the masking position, and controls the maintenance unit so as to be converted to the non-masking state which becomes the head maintenance enabling state, by moving the masking blade to the evacuating position after securing the non-irradiating state in which the ultraviolet rays irradiated from the ultraviolet irradiating device are not irradiated on the maintenance unit, by the function provided by the unit other than the maintenance unit when the head maintenance is performed, to thereby reliably prevent the maintenance unit from the ultraviolet rays irradiated from the ultraviolet irradiating device. Especially, when the masking blade is moved to the masking position in the invention, the masking blade covers over the maintenance unit to thereby mask all the component parts such as the absorbing device and the wiping device constructing the maintenance unit.

Therefore, the reliable and excellent head maintenance is performed. Especially, when the masking blade is moved to the masking position in the invention, the masking blade covers over the maintenance unit to thereby mask all the component parts such as the absorbing device and the wiping device constructing the maintenance unit and to prevent various defects such as reduction of closing performance of the absorbing cap of the absorbing device due to deterioration of the absorbing device and curing of the ink of the absorbing device and reduction of wiping performance for ink due to deterioration of the wiping device and curing of the ink of the wiping device.

Further, it is preferable that the maintenance unit is movable between a maintenance region in which the head maintenance is performed within a scanning area of the carriage, and an evacuating region in which the maintenance unit is located outside the scanning area of the carriage so as not to be exposed to the ultraviolet rays irradiated from the ultraviolet irradiating device, and the control section controls the maintenance unit so as to be converted to the masking state which becomes the head maintenance disabling state when the image is formed, by moving the maintenance unit to the evacuating region, and controls the maintenance unit so as to be converted to the non-masking state which becomes the head maintenance enabling state, by moving the maintenance unit into the maintenance region after securing the non-irradiating state in which the ultraviolet rays irradiated from the ultraviolet irradiating device are not irradiated on the maintenance unit, by the function provided by the unit other than the maintenance unit when the head maintenance is performed.

By use of such ink jet printer, the maintenance unit is movable between a maintenance region in which the head maintenance is performed within a scanning area of the carriage, and an evacuating region in which the maintenance unit is located outside the scanning area of the carriage so as not to be exposed to the ultraviolet rays irradiated from the ultraviolet irradiating device, and the control section controls the maintenance unit so as to be converted to the masking state which becomes the head maintenance disabling state when the image is formed, by moving the maintenance unit to the evacuating region, and controls the maintenance unit so as to be converted to the non-masking state which becomes the head maintenance enabling state, by moving the maintenance unit into the maintenance region after securing the non-irradiating state in which the ultraviolet rays irradiated from the ultraviolet irradiating device are not irradiated on the maintenance unit, by the function provided by the unit other than the maintenance unit when the head maintenance is performed, to thereby more reliably prevent the maintenance unit from the ultraviolet rays irradiated from the ultraviolet irradiating device. Especially, the overall maintenance unit is moved in the invention to thereby mask over the component parts such as the absorbing device and the wiping device constructing the maintenance unit when the maintenance unit is moved to the evacuating region. Further, when forming the image, the maintenance unit is positioned at the evacuating region far away from the ultraviolet irradiating device to thereby prevent the maintenance unit from the heat emitted from the ultraviolet light source.

Therefore, more reliable and excellent head maintenance is performed. Especially, the overall maintenance unit is moved in the invention to thereby mask over the component parts such as the cap parts and the ink absorbing device constructing the maintenance unit when the maintenance unit is moved to the evacuating region and to prevent various defects such as reduction of closing performance of the absorbing cap of the absorbing device due to deterioration of the absorbing device and curing of the ink of the absorbing device and reduction of wiping performance for ink due to deterioration of the wiping device and curing of the ink of the wiping device. Further, the maintenance unit is prevented from the heat emitted from the ultraviolet light source to thereby prevent defects resulted from the heat in the maintenance unit.

Further, it is preferable that the function provided by the unit other than the maintenance unit includes a masking device for switching an irradiating state and the non-irradiating state of the ultraviolet rays.

By use of such ink jet printer, the function provided by the unit other than the maintenance unit includes a masking device for switching an irradiating state and the non-irradiating state of the ultraviolet rays, to thereby when the head maintenance is performed, switch the non-irradiating state of the ultraviolet rays by covering the ultraviolet light source of the ultraviolet irradiating device with the masking device.

Therefore, the switching between the irradiating state and the non-irradiating state can be attained with simple structure more rapidly and in good timing.

Assuming, for example, that the function of switching the irradiation of ultraviolet rays is performed by turning on and off the ultraviolet light source, if the ultraviolet light source is once turned off, it needs to wait for a certain elapsing time before turning on again, or it takes time for the ultraviolet rays to reach a predetermined amount of irradiation after turning on. On the other hand, if this switching function is performed by the movement of the masking device with the ultraviolet light source kept lighting, above problem can be avoided, and the switching between the irradiating state and the non-irradiating state can be attained more quickly at necessitated timing.

Further, compared with the switching method of turning on and off the ultraviolet light source, in case the ultraviolet light source is always lit, deterioration of the ultraviolet light source can be reduced, leading to longer life of the ultraviolet light source and a resultant lower cost.

Further, it is preferable that the masking device is provided by the ultraviolet irradiating device.

By use of such ink jet printer, the masking device is provided by the ultraviolet irradiating device to thereby compactly house the masking device.

Therefore, space may be effectively saved and the masking device may be disposed at the position the ultraviolet irradiating device is reliably masked.

Further, it is preferable that the ultraviolet light source in the ultraviolet irradiating device includes any one of high-pressure mercury lamp, metal halide lamp, hot cathode tube, cold cathode tube, LED, Microwave lamp, excimer lamp, and low-pressure mercury lamp.

Like this, if the ultraviolet light source in the ultraviolet irradiating device of the ink jet printer includes any one of high-pressure mercury lamp, metal halide lamp, hot cathode tube, cold cathode tube, LED, Microwave lamp, excimer lamp, and low-pressure mercury lamp, it takes the same effect as the invention described in claim 1.

Further, it is preferable that the ink jetted from the recording head is cationic curable ink.

By use of such ink jet printer, the ink jetted from the recording head is cationic curable ink. The cationic curable ink is more sensitive to the ultraviolet rays than the radical curable ink, and therefore easily affected by the ultraviolet rays when sticking to the maintenance unit, but in this case, the head maintenance is performed with the ultraviolet masking state of the maintenance unit released after the ultraviolet rays irradiated from the ultraviolet irradiating device is brought into the non-irradiating state. Therefore, even cationic curable ink can be prevented from increase of the viscosity or its curing.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

DETAILED DESCRIPTION OF THE PREFERRED EMBODIMENTS

Embodiments of the present invention will now be descried in detail with reference to the drawings. The description will not limit the scope of the invention to the exemplified drawings.

First Embodiment

Figure 1:
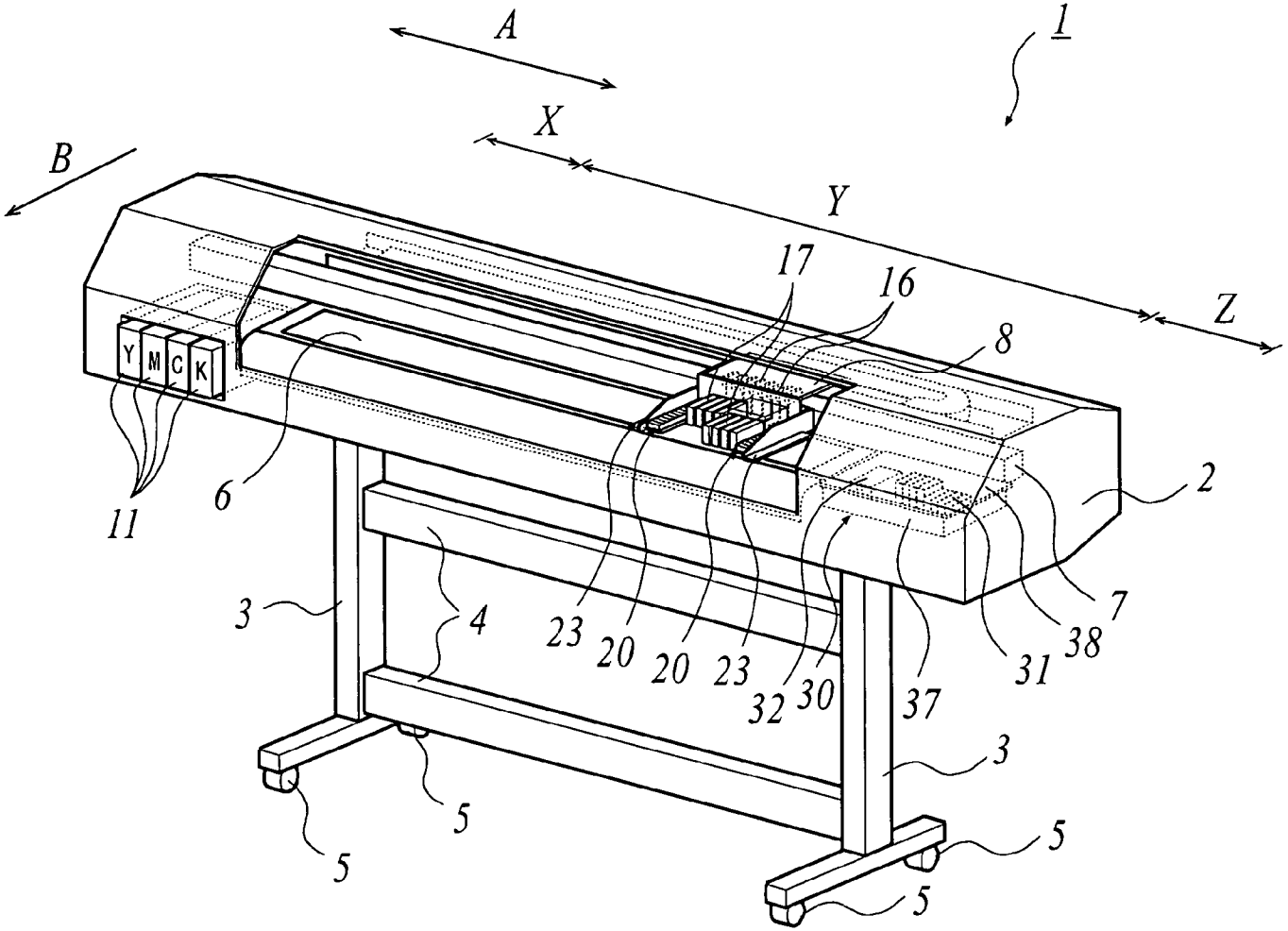
FIG. 1 is a perspective view of an ink jet printer in accordance with one embodiment of the present invention.

FIG. 1 is a perspective view of an ink jet printer 1 adopting a serial type image recording method.

As shown in FIG. 1, the ink jet printer 1 has an elongated housing 2 extending in a right-and-left direction. A cross sectional shape taken along a surface perpendicular to the longitudinal direction of the housing 2 shows a polygons a part of the front of the housing 2 is opened, and a slit-like inlet (not shown) is provided at the rear side of the housing 2. A web of recording medium (not shown) is fed through the inlet into the inside of the housing 2.

Under the housing 2, there are attached two inverted T-shaped legs 3 for supporting the housing 2. Between the two legs 3, two reinforcing members 4 are bridged for strongly supporting the housing 2. Each of the legs 3 has two casters 5 attached at the lower part thereof so that the entire ink jet printer 1 can move on all sides by the caster 5.

Inside the housing 2, a plate-like platen 6 extending in the right-and-left direction is provided for supporting the web of recording medium from the back.

Figure 6:
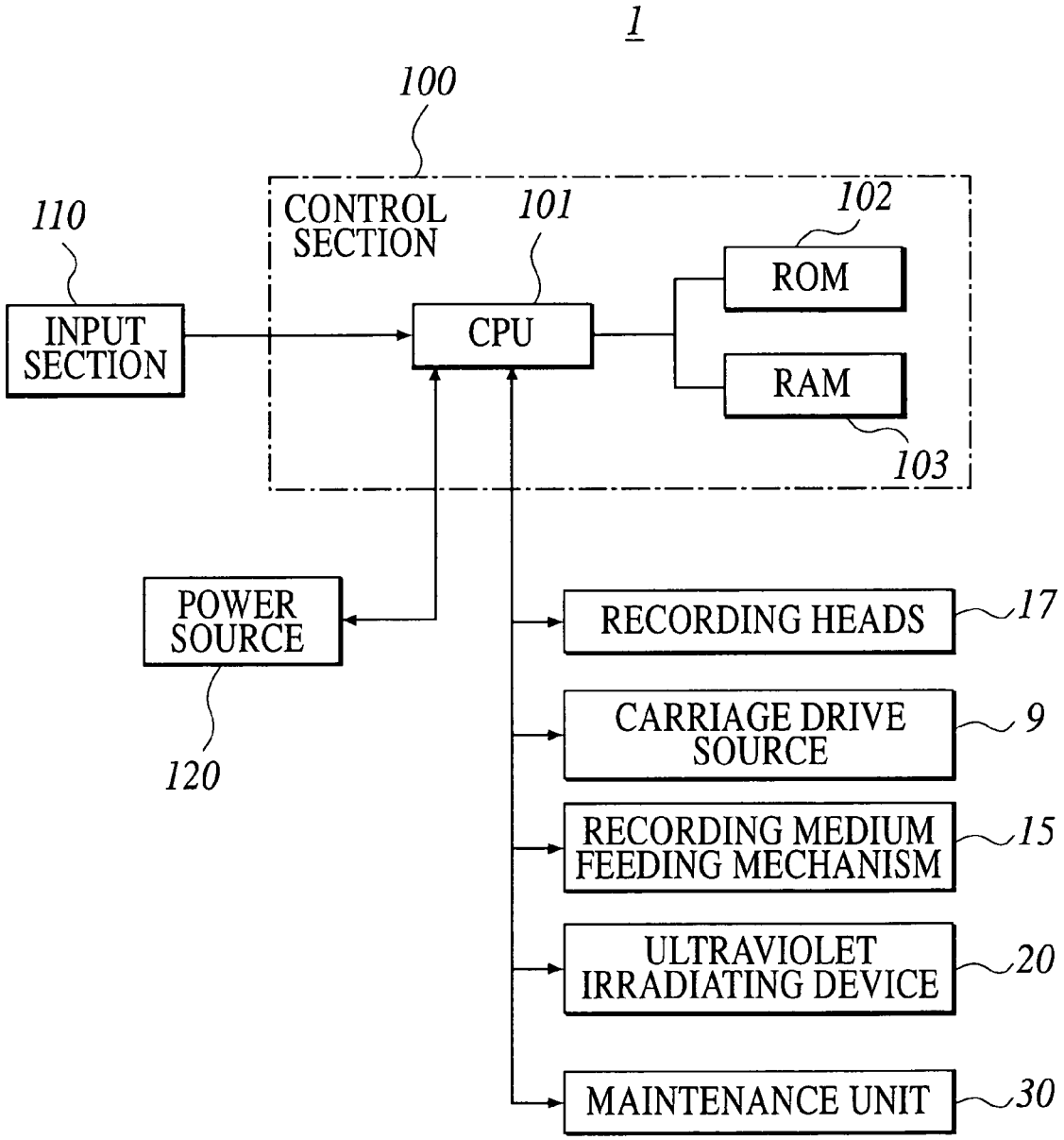
FIG. 6 is a block diagram showing the main elements of the ink jet printer according to the present invention.

Although the recording medium on which an image is recorded is not shown in FIG. 1, the recording medium is fed inside through the inlet disposed in the rear of the housing 2, passes through the inside of the housing 2 from the rear to the front, being supported on the platen 6, and fed outside the housing 2 by a recording medium transport mechanism 15 (shown in FIG. 6). That is, the recording medium transport mechanism 15 feeds the recording medium in a feeding direction B so as to pass through the inside of the housing 2.

The recording medium feeding mechanism 15 has, for example, a feed motor and a feed roller (not shown), and feeds the recording medium with the feed motor driven to rotate the feed roller. When an image is formed, the recording medium feeding mechanism 15 intermittently feeds the recording medium in synchronism with the movement of a carriage 8 described later, repeating advancement and halt of the recording medium.

Above the platen 6 provided is a guide member 7 extending in the right-and-left direction inside the housing 2. The guide member 7 supports a carriage 8, which is movable guided by the guide member 7 in the right-and-left direction (scanning direction A) within a predetermined area (scanning area). Here, the carriage 8 moves along the guide member 7 with a carriage drive source 9 (shown in FIG. 6) energized.

The scanning area has a home position region X, a recording region Y, and a maintenance region Z according to their purposes and functions. At the recording region Y, the platen 6 is provided, and the ink is jetted on the recording medium with the medium fed for forming images.

The carriage 8 will be explained below.

Figure 2:
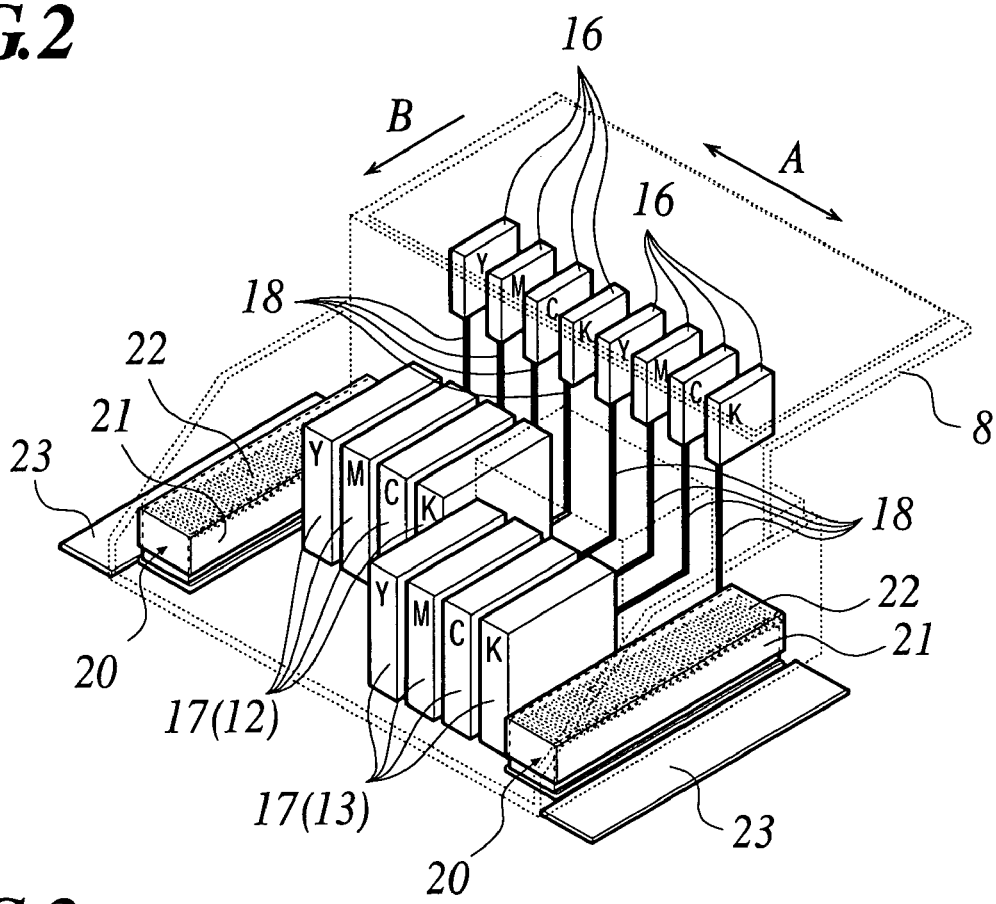
FIG. 2 is a perspective view showing a carriage provided in the ink jet printer of FIG. 1.
Figure 3:
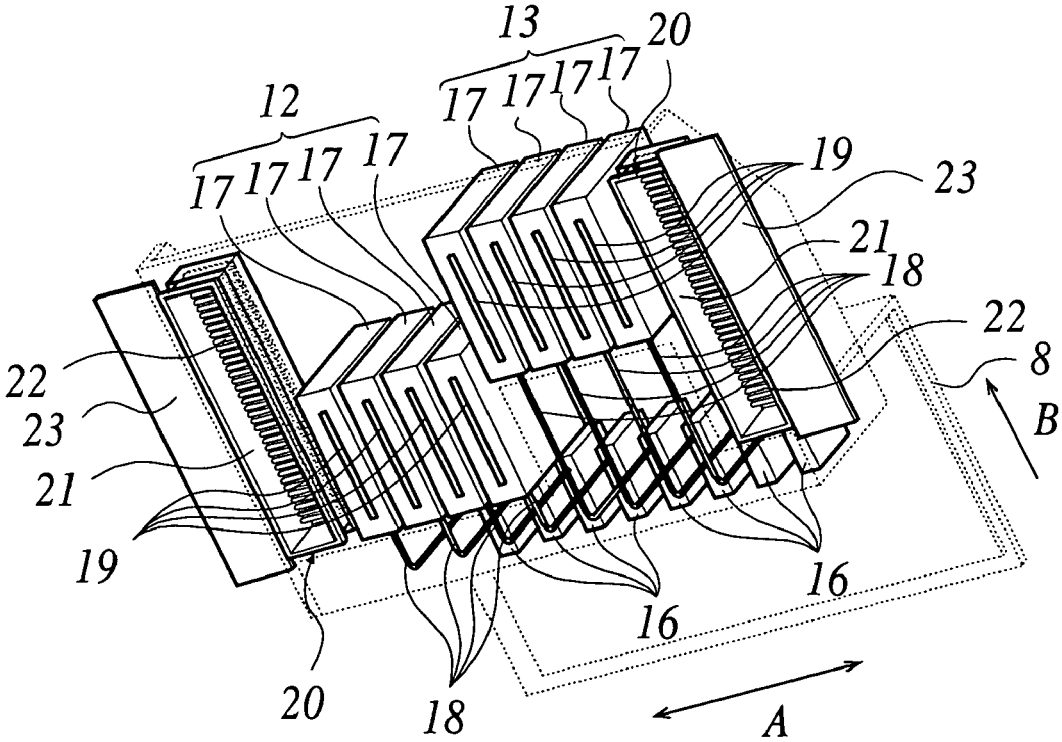
FIG. 3 is a perspective view viewed from the bottom of the carriage of FIG. 2.

FIG. 2 is a perspective view of the carriage 8 viewed from almost the same direction as in FIG. 1, and FIG. 3 is that viewed upward on a slant from lower right side. In FIGS. 2 and 3, the carriage 8 is depicted by dotted lines in perspective.

Referring to FIG. 2, eight recording heads 17 for jetting the ink are mounted in front side of the carriage 8, being divided into two groups 12 and 13 of 4 heads. Each group 12 and 13 has four recording heads 17 aligned in the scanning direction A, and one group 12 is arranged at left and upstream side in the feeding direction B with respect to the other group 13. Each recording head 17 is connected with a sub-tank 16 through a supply tube 18 for supplying the ink of each color from the sub-tank 16 to the recording head 17.

The recording head 17 is formed in a near rectangular parallelepiped, and disposed so that the longitudinal side thereof is in parallel with the feeding direction B. Each recording head 17 has a jetting surface of nozzles on its lower surface facing the recording medium fed on the platen 6. Each recording head 17 has on the jetting surface a plurality of jet openings of nozzles aligned in the feeding direction B for jetting the ink, constituting a jet opening line 19. Each recording head 17 has an element, such as a piezoelectric element or a heating element, to give pressure to the inside ink for each jet opening for causing the jet opening to jet droplets from the jet opening.

Each recording head 17 jets any one of colors of ink, yellow (Y), magenta (M), cyan (C) and black (B), and the recording heads 17 of the groups 12 and 13 jet the respective different colors of ink from each other in the group. In FIG. 2, alphabetic characters on the recording heads 17 indicate the respective colors of ink to be jetted.

Mounted at the rear side of the carriage 8 are eight sub-tanks 16 aligned in the scanning direction A. The sub-tanks 16 temporarily reserve respective colors of ink supplied from ink tanks 11. In FIG. 2, alphabetic characters on the sub-tanks 16 indicate the respective colors of ink to be reserved.

At both ends of the carriage 8, ultraviolet irradiating devices 20 are mounted for irradiating ultraviolet rays. The ultraviolet irradiating devices 20 at one side are disposed at a farther left side of the recording head 17 positioned at left side, and the other side ultraviolet irradiating devices 20 at a farther right side of the recording head 17 positioned at right side.

The ultraviolet irradiating devices 20 will be described in detail referring to FIG. 3.

The ultraviolet irradiating devices 20 have a cover member 21 mounted on the carriage 8. The cover member 21 is so formed as to be opened toward the recording medium and the platen 6 arranged under it. A rear end of the cover member 21 is aligned with the rear end of the recording head 17 of the group 12 positioned at the rear side, or aligned with farther rear side. A front end of the cover member 21 is aligned with the same front end of the recording head 17 of the head group 13 positioned at the front side, or aligned with farther front side.

On an entire inner surface of the cover member 21, a reflection member is affixed for reflecting the ultraviolet rays. As the reflection member, for example, a reflection plate, which is made of highly purified aluminum to efficiently reflect the ultraviolet rays in its entire wavelength range, is applicable, and preferably applicable is a cold mirror (molded glass plate), which is so made that a metal compound film containing mainly aluminum is vapor-deposited on a glass surface. Especially, the cold mirror effectively reflects the ultraviolet rays on one hand, and on the other hand, transmits visible light and infrared rays, which do not contribute to curing of ink, through the mirror backward, preventing a later described ultraviolet light sources 22 from reduction of the luminous efficiency due to their heat-up.

Provided inside an opening recess of the cover member 21 are a plurality of ultraviolet light sources 22, which are enclosed with the cover member 21. The ultraviolet light sources 22 are each linear one extending along the scanning direction A, and arranged on the upper surface of the cover member 21 so that the longitudinal directions are in parallel with each other and side by side in the feeding direction B.

Each ultraviolet light source 22 irradiates ultraviolet rays radially from a center line extending along the longitudinal direction. It is preferable to employ as the ultraviolet light source 22 at least any one of high-pressure mercury lamp, metal halide lamp, hot cathode tube, cold cathode tube or LED.

Further, the ultraviolet irradiating device 20 is switchable between an irradiating state and a non-irradiating state of ultraviolet rays. In the ultraviolet irradiating device 20 of the embodiment, the ultraviolet light sources 22 is always lit, and masking devices 23 capable of intercepting the ultraviolet rays irradiated from the ultraviolet light sources 22 are provided outside the respective ultraviolet irradiating devices 20 in the scanning direction A on the carriage 8.

The masking device 23 of the first embodiment has a near rectangular plate member, and has a size and a shape for sufficiently covering the entire opening of the cover member 21 which is an irradiating surface of the ultraviolet irradiating device 20. The plate member of the masking device 23 is movable between an irradiating state position, where the masking device 23 is positioned outside the irradiating surface in the scanning direction A so as not to cover the irradiating surface, and a non-irradiating state position where the masking device 23 covers the irradiating surface. As for the method of switching between the irradiating state and the non-irradiating state, a proper method may be employed such as sliding movement and rotating movement. The movement of the masking device 23 switches between the irradiating state and the non-irradiating state of the ultraviolet rays in the ultraviolet irradiating device 20.

At the left side of the platen 6 in the scanning direction A, there is provided the home position region X where the recording heads 17 are on standby except the time of image forming and head maintenance.

Provided in the home position region X is a masking unit, not shown, which has plural masking caps (not shown) corresponding to the number of recording heads 17 for protecting jet openings of the recording heads 17 from exposure to the ultraviolet rays when the image is not formed.

The masking unit is provided with a masking unit moving mechanism not shown, for moving the masking unit up and down.

Under the home position region X, there are provided a plurality of ink tanks 11 for reserving ink. The colors of ink used in the ink jet printer 1 are basically yellow (Y), magenta (M), cyan (C) and black (K), and additionally white (W), light yellow (LY), light magenta (LM), light cyan (LC) and light black (LK). One ink tank 11 reserves one of the above colors of ink. The plural ink tanks 11 basically reserve different colors of ink, respectively, but the same color of ink may be reserved in two or more ink tanks 11. Meanwhile, alphabetic characters on the ink tanks 11 in FIG. 1 indicate the colors of ink reserved therein.

Provided at the right side of the platen 6 in the scanning direction A is the maintenance region Z in which a maintenance unit 30 is installed. The maintenance region Z performs the maintenance for the recording heads 17 mounted in the carriage 8. The maintenance unit 30 is disposed under the scanning area of the carriage 8.

The maintenance unit 30 has absorbing caps 31 of the absorbing device corresponding to the number of the recording heads 17 for covering the jet openings of the recording heads 17 at the position facing the recording heads 17 when the carriage 8 has been moved to the maintenance region Z. In the first embodiment, when the ink is jetted from the jet openings as dummy jetting, the absorbing caps 31 receive the jetted ink.

Further, the maintenance unit 30 has a wiping device 32 adjacent to the absorbing caps 31 for wiping the ink remaining in the jetting surface of the recording head 17.

The maintenance unit 30 is provided with a maintenance unit moving mechanism not shown, for moving the maintenance unit 30 up and down.

Figure 4:
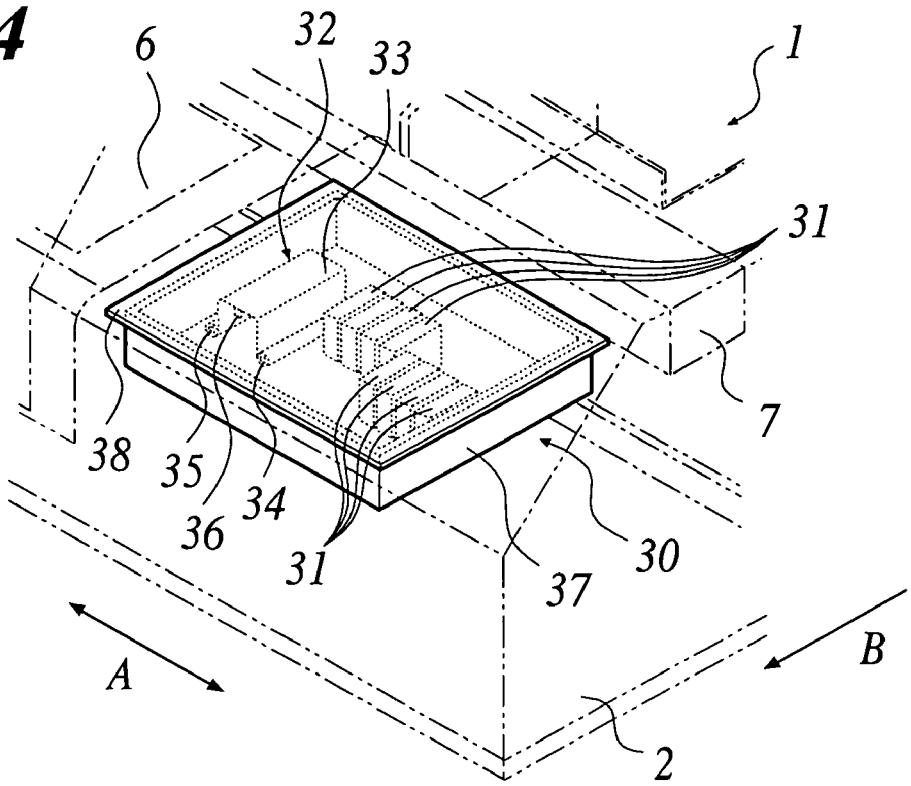
FIG. 4 is a perspective view showing a maintenance unit provided in the ink jet printer of FIG. 1 in a state at the time of image forming.
Figure 5:
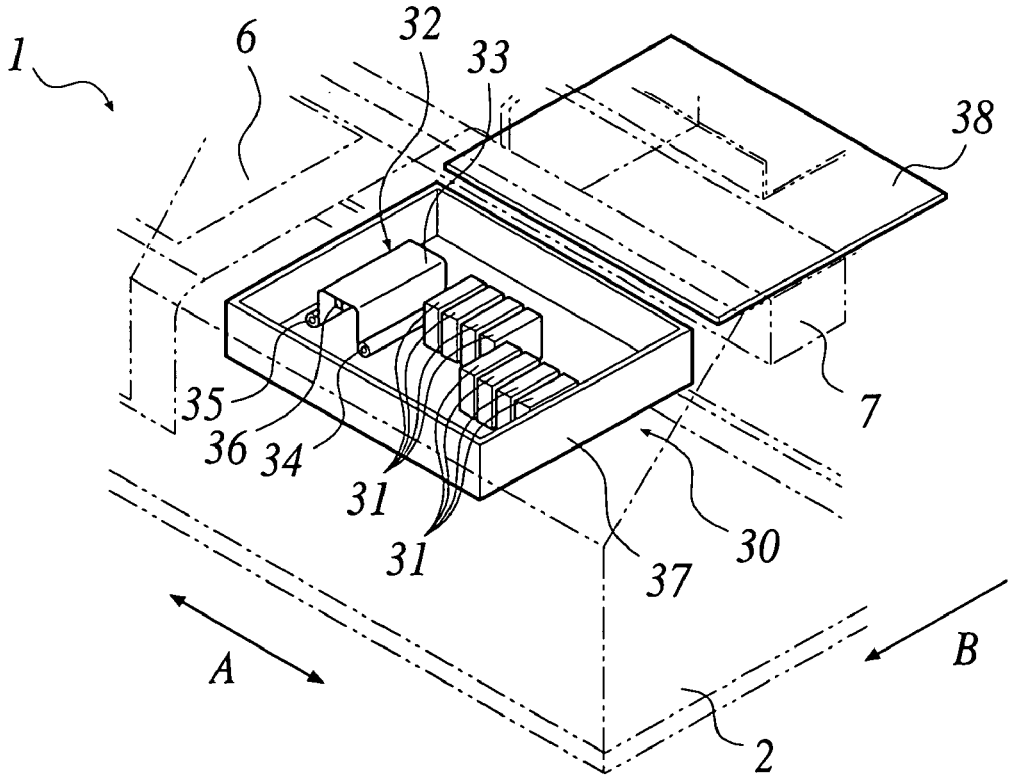
FIG. 5 is a perspective view showing the maintenance unit of FIG. 4 in a state at the time of head maintenance.

As shown in FIGS. 4 and 5, the wiping device 32 has a sheet-like ink absorbing member 33, a first roll shaft 34 and a second roll shaft 35 for rolling the ink absorbing member 33 around them, a heater 36 disposed under the ink absorbing member 33 between the first and second roll shafts 34 and 35 for heating the ink absorbing member 33, a roll shaft drive mechanism not shown, and the like.

The entire maintenance unit 30 including the absorbing device of the absorbing caps 31 and the wiping device 32 in the embodiment is accommodated in a case 37 for masking the ultraviolet rays. Besides, for example, a partial member of an absorbing pump or the like of the absorbing device may not be housed in the case 37, but provided outside the case. Further, the case 37 is open upward, at the side facing the recording heads 17 and the ultraviolet irradiating device 20, and has a masking blade 38 with a size and shape for sufficiently covering the whole upside jet opening of the case 37. The masking blade 38 is movable between a masking position locating above the maintenance unit 30 and an evacuating position locating at upstream side in the feeding direction B. Here, the maintenance unit 30 is in the masking state in which the ultraviolet rays are masked when the masking blade 38 is positioned at the masking position, and the maintenance unit 30 is in the non-masking state in which the ultraviolet rays are not masked when the masking blade 38 is positioned at the evacuating position.

At the time of image forming, the masking blade 38 is positioned at the masking position as shown in FIG. 4 for masking the ultraviolet rays irradiated from the ultraviolet irradiating device 20, and thus the inside such as the absorbing device having the absorbing caps 31 and the wipe device 32 of the maintenance unit 30 is protected from exposure to the ultraviolet rays by masking it. This state constitutes a head maintenance disabling state in which the head maintenance cannot be performed due to the covering by the masking blade 38.

At the time of head maintenance, the masking blade 38 is moved to the evacuating position as shown in FIG. 5 to constitute a head maintenance enabling state in which the head maintenance can be performed. At this time, the masking blade 38 is not positioned above the maintenance unit 30, thereby to be in the non-masking state not to mask the ultraviolet rays.

Meanwhile, the maintenance unit 30 is provided with a masking blade moving mechanism not shown, for moving the masking blade 38 between the masking position and the evacuating position.

A control section of the first embodiment will now be explained with reference to FIG. 6.

As shown in FIG. 6, the control section 100 has approximately a CPU 101 for executing various processing, a ROM 102 for storing various programs for various processing such as control and determination, and for storing various data, and a RAM 103 having working areas and memory areas for temporarily storing data produced by various processing.

The control section 100 executes various controls according to the various programs stored in the ROM 102, such as drive control for the carriage 8 and the recording heads 17, feed control for the recording medium, irradiation control for the ultraviolet rays, and head maintenance operation control by the maintenance unit 30.

Further, the control section 100 is connected to an input section 110 having a keyboard and an operation panel for inputting operational commands, data and information, a power source 120, the recording heads 17, a carriage drive source 9, the recording medium transport mechanism 15, the ultraviolet irradiating device 20, and the maintenance unit 30 through respective interfaces not shown.

Applicable to the recording medium used in the first embodiment are various kinds of paper usually applied to inkjet printers, such as standard paper, recycled paper and glossy paper, various fabrics, various non-woven fabrics, and medium consisting of resin, metal, glass, or the like. As a form of the recording medium, roll-shaped, cut-sheet, and plate-shaped media are usable.

Particularly applicable to the recording medium in the first embodiment is a transparent or opaque non-absorbable resin film used for a flexible package. The kinds of specific resin for the resin film are: polyethylene terephthalate, polyester, polyolefin, polyamide, polyester-amide, polyether, polyimide, polyamideimide, polystyrene, polycarbonate, poly-ρ-phenylene sulfide, polyether-ester, polyvinyl chloride, polyacrylate, polyethylene, polypropylene, nylon, and further copolymer of these resins, mixture of these resins, and cross-linked resins. Out of these resins, stretched polyethylene terephthalate, polystyrene, polypropylene and nylon are preferably selected from their transparency, dimension stability, rigidity, environmental load and cost points of view. Specifically, a resin film having a sickness of more than 2 μm and less than 100 μm (preferably 6 to 50 μm) is preferably used. To a surface of the resin film base, there may be applied surface treatment such as corona treatment and adhesion pretreated.

Also applicable to the recording medium in the first embodiment are known opaque medium, such as various resin-coated paper, a film containing pigment, an foamed film, or the like.

Further, applicable to the ink in the first embodiment is the ink adapted especially to such as "CURING SYSTEM (first chapter)" and "PHOTOINDUCED ALTERNATING COPOLYMERIZATION (second chapter)" of "PHOTOCOAGULATION SYSTEM (fourth chapter)" written in "SELECTION FOR PHOTOCOAGULATION TECHNIQUE—RESIN-BASE DEVELOPMENT AGENT AND MEASUREMENT-EVALUATION FOR COMBINATION CONDITION AND CURABILITY—(AMERICAN INSTITUTE OF TECHNOLOGY)." The ink curable by the normal radical polymerization is also applicable in the embodiment.

Specifically, the ink applied in the first embodiment is an ultraviolet curable ink which is cured by the irradiation of the ultraviolet rays as a light, and has as a main element, a polymerized compound (or may be a publicly known polymerized compound), a photo initiator, and color material at least. Besides, a photo initiator may be omitted in case the ink adjusted to the above "PHOTOINDUCED ALTERNATING COPORYMERIZATION (second chapter)" is used as the ink applied in the first embodiment.

Ultraviolet curable ink is, as polymerized compound, broadly categorized into radical curable ink including radical polymerized compound and cationic curable ink including cationic polymerized compound, and both types of ink are applicable to the embodiment. Hybrid type of ink mixed with the radical curable ink and the cationic curable ink may also be applied as the ink used in the first embodiment.

However, because the cationic curable ink that is not or slightly affected by the polymerization reaction of oxygen is good at functionality and versatility, the cationic curable ink is particularly used in the first embodiment. The cationic curable ink used in the first embodiment is a composite including especially the cationic polymerized compound such as oxycetane compound, epoxy compound, vinyl ether compound and the like, the photo cationic initiator, and the color material at least, and is curable by the irradiation of the ultraviolet rays as described above.

A description will now be given of the operations of the ink jet printer 1 configured as described above referring to FIGS. 6 and 7.

Initially, when the power source of the ink jet printer 1 according to the first embodiment is turned on, the ultraviolet light sources 22 of the ultraviolet irradiating device 20 are lit, and kept lighting until the power source is turned off in the first embodiment.

When the control section 100 receives given image forming information, forming the image starts. When an image is formed, the control section 100 drives the carriage 8, which has the recording heads 17 and the ultraviolet irradiating device 20 thereon, to reciprocate the recording heads 17 and the ultraviolet irradiating device 20 in the main scanning direction A, with the recording medium fed by the recording medium feeding mechanism 15 in the feeding direction B perpendicular to the main scanning direction A, during which desired colors of ink droplets are jetted from the respective jet openings of the recording heads 17 based on the given image forming information. At this time, the ultraviolet irradiating device 20 is in the irradiating state in which the plate member of the masking device 23 of the ultraviolet irradiating device 20 is positioned outside the ultraviolet light sources 22 in the scanning direction A so as not to cover the irradiating surface of the ultraviolet light source 22. The ink droplets jetted from the recording heads are disposed on the recording medium, and irradiated by the ultraviolet rays irradiated from the ultraviolet irradiating device 20 to be fixed, whereby the image is formed on the recording medium, that is, printed out.

When an image is formed, the control section 100 brings the maintenance unit 30 into the masking state which becomes the head maintenance disable state as shown in FIG. 4, in which the masking blade 38 of the maintenance unit 30 is positioned at the masking position above the jet opening portion of the case 37 of the maintenance unit 30. In this state, even if the carriage 8 enters the maintenance region Z during image forming, the ultraviolet rays irradiated from the ultraviolet irradiating device 20 are masked, and thus the inside such as the absorbing device having the absorbing caps 31 and the wiping device 32 of the maintenance unit 30 is prevented from exposure to the ultraviolet rays.

On the other hand, the control section 100 starts executing head maintenance process when a predetermined condition is met, for example, various sensors (not shown) detect the clogging at the jet openings due to increase of ink viscosity or adhered ink, the clogging in ink flow channels due to bubbles or contaminants in the recording heads 17, or a predetermined time having elapsed from turning on the power source.

Figure 7:
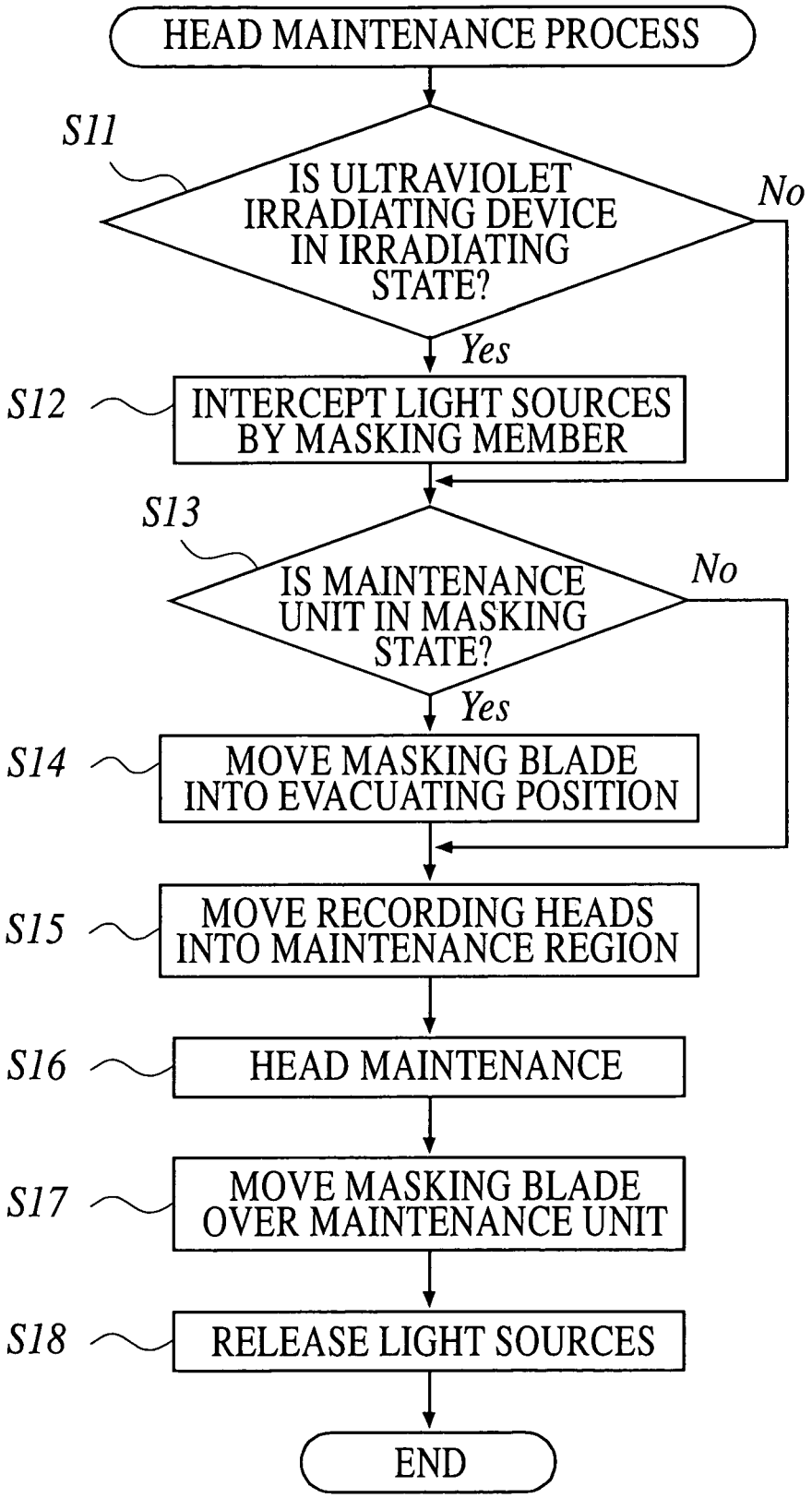
FIG. 7 is a flow chart showing one example of head maintenance process in the ink jet printer according to the present invention.

The head maintenance process will be explained below with reference to a flowchart of FIG. 7.

When the head maintenance is going on, the control section 100 first determines whether the ultraviolet irradiating device 20, when the carriage 8 is in the recording position Y or in the home position region X, is in the irradiating state or in the non-irradiating state, that is, whether the plate member of the masking device 23 that is also a masking function provided by the unit other than the maintenance unit 30 does not intercept the ultraviolet rays from the ultraviolet irradiating device 20 without covering the opening of the cover member 21, or intercepts the ultraviolet rays by covering the opening of the cover member 21 (step S11). If the non-irradiating state of the ultraviolet rays irradiated from the ultraviolet irradiating device 20 to the maintenance unit 30 is secured while the masking device 23 is intercepting the ultraviolet rays, the ultraviolet irradiating device 20 is kept as is.

If the masking device 23 does not intercept the ultraviolet rays and the ultraviolet irradiating device 20 is in the irradiating state, the plate member of the masking device 23 is moved to the position where the masking member 23 covers the opening of the cover member 21 for intercepting the ultraviolet rays irradiated from the ultraviolet light source 22 and switching the irradiating device 20 into the non-irradiating state (step S12). Therefore, in the masking device 23 that is also the masking function provided by the unit other than the maintenance unit 30, this process securely brings the maintenance unit 30 into the state of being protected from irradiation of the ultraviolet rays.

Next, the control section 100 determines whether the maintenance unit 30 itself is in the masking state or not, that is, whether the masking blade 38 of the maintenance unit 30 is positioned at the masking position to mask the ultraviolet rays irradiated from the ultraviolet irradiating device 20 for producing the head maintenance disabling state so as not to prevent the inside such as the absorbing device having the absorbing caps 31 and the wiping device 32 of the maintenance unit 30 from exposure to the ultraviolet rays, or the masking blade 38 is positioned at the evacuating position in which the ultraviolet rays irradiated from the ultraviolet irradiating device 20 for producing the head maintenance enabling state (step S13). If the masking blade 38 is positioned at the evacuating position as shown in FIG. 5, the head maintenance unit 30 is kept as is.

Contrary, if the masking blade 38 is positioned at the masking position and the maintenance unit is in the head maintenance disabling state, the masking blade 38 is moved to the evacuating position for converting the maintenance unit 30 to the non masking state which becomes the head maintenance enabling state (step S14).

Then, the carriage 8, having the recording heads 17 and the ultraviolet irradiating devices 20 in the non-irradiating state thereon, is moved to the maintenance region Z (step S15), and the head maintenance is performed (step S16).

Regarding the operation of the head maintenance, the maintenance unit 30 is first moved upward after the recording heads 17 reaches a predetermined position in the maintenance region Z. This upward movement allows the absorbing caps 31 of the absorbing device on the maintenance unit 30 to cover and tightly shut the jetting surfaces of the recording heads 17. Thereafter, the control section 100 activates an absorbing pump (not shown) for creating negative pressure inside the absorbing caps 31, thereby to absorb the ink inside the jet openings and the nozzles. The ink absorbed from the jet openings and the nozzles is gradually soaked into an absorbent member upon touching the absorbent member provided within the absorbing caps 31 facing the jet openings. The soaked-in ink is fed to a waste ink tank through a connecting pipe and stored therein.

After completing the absorption, the maintenance unit 30 is once moved downward to separate the absorbing caps 31 apart from the jetting surfaces.

Next, the recording heads 17 are moved to a position facing the wiping device 32 of the maintenance region Z, and then the maintenance unit 30 is moved upward. This upward movement allows the jetting surfaces of the recording heads 17 to get contact with the ink absorbing member 33 bridged between the first and second roll shafts 34 and 35. Then, the ink absorbing member 33 wipes the ink adhered to the jetting surfaces. At this time, the heater 36 heats the ink absorbing member 33 to have the ink absorbed in the ink absorbing member 33 more easily.

Then, the maintenance unit 30 is moved downward to separate the ink absorbing member 31 apart from the jetting surfaces.

The recording heads 17 are again moved to the position facing the absorbing caps 31, and dummy jetting of ink from the jet openings toward the absorbing caps 31 is applied by energizing, for example, piezoelectric elements.

Thereby, the maintenance operation of the jet openings of the recording heads 17 is completed. As a result of the head maintenance, the recording heads 17 are prepared in good condition for forming images.

Thereafter, a roll shaft driving mechanism not shown, drives the first and second roll shafts 34 and 35 so that the ink absorbing member 33 is fed from the first roll shaft 34 and the second roll shaft 35 rolls the ink absorbing member 33 thereon by the range the ink has been absorbed therein.

Subsequently, the masking blade 38 of the maintenance unit 30 is moved to the masking position over the maintenance unit 30 for converting to the masking state which becomes the head maintenance disabling state (step S17). Then, the plate member of the masking device 23 is moved to the position which is not cover the irradiating surface and which is in the outside of the irradiating surface of the ultraviolet irradiating device 20 for releasing the ultraviolet light source 22, thereby bringing the ultraviolet irradiating device 20 into the ultraviolet irradiating state, and allowing the ink jet printer 1 to form images (step S18).

As described above, in the ink jet printer according to the first embodiment, the maintenance unit has the function switchable between the masking state in which the ultraviolet rays are masked and the non-masking state in which the ultraviolet rays are not masked, the masking state being the head maintenance disabling state in which the head maintenance is not allowed, and the non-masking state being the head maintenance enabling state in which the head maintenance is allowed. The control section is provided for controlling the maintenance unit so as to be converted to the masking state which becomes the head maintenance disabling state when the image is formed, and for controlling the maintenance unit so as to be converted to the non-masking state which becomes the head maintenance enabling state after securing the non-irradiating state in which the ultraviolet rays irradiated from the ultraviolet irradiating device are not irradiated on the maintenance unit, by a function provided by an unit other than the maintenance unit when the head maintenance is performed, allowing the maintenance unit to be protected from the ultraviolet rays irradiated from the ultraviolet irradiating device. Especially, when the maintenance unit is brought into the masking state in which the ultraviolet rays are masked, the ultraviolet rays are not irradiated over the maintenance unit to thereby mask all component parts such as the absorbing device having the absorbing cap for recovering the clogging by absorbing the ink with the jet openings closed and the wiping device for removing the ink adhered on the jetting surface.

Therefore, this structure prevents the maintenance unit from having defects, such as deterioration of its constructing parts due to irradiation of ultraviolet rays and reduction of maintenance performance due to curing of the ultraviolet curable ink adhered to the maintenance unit by irradiation of ultraviolet rays, thereby performing excellent head maintenance. Especially, all component parts such as the absorbing device and the wiping device may be masked to thereby prevent various defects such as reduction of closing performance of the absorbing caps of the absorbing device due to deterioration of the absorbing device and curing of the ink of the absorbing device and reduction of wiping performance for ink due to deterioration of the wiping device and curing of the ink of the wiping device.

Further in the first embodiment, the maintenance unit has a masking blade at a side facing the ultraviolet irradiating device, the masking blade being switchable between a masking position in which the ultraviolet rays irradiated from the ultraviolet irradiating device are masked and the evacuating position in which the ultraviolet rays are not masked. The control section is provided for controlling the maintenance unit so as to be converted to the masking state which becomes the head maintenance disabling state when the image is formed by moving the masking blade to the masking position, and for controlling the maintenance unit so as to be converted to the head maintenance enabling state which becomes the head maintenance enabling state by moving the masking blade to the evacuating position after securing the non-irradiating state in which the ultraviolet rays irradiated from the ultraviolet irradiating device are not irradiated on the maintenance unit, by the function provided by the unit other than the maintenance unit when the head maintenance is performed. Thus, the maintenance unit is securely protected from irradiation of the ultraviolet rays irradiated from the ultraviolet irradiating device.

Therefore, the reliable and excellent head maintenance is performed. Especially, when the masking blade is moved to the masking position, the masking blade covers over the maintenance unit to thereby mask all the component parts such as the absorbing device and the wiping device constructing the maintenance unit and to prevent various defects such as reduction of closing performance of the absorbing cap of the absorbing device due to deterioration of the absorbing device and curing of the ink of the absorbing device and reduction of wiping performance for ink due to deterioration of the wiping device and curing of the ink of the wiping device.

Further, in the first embodiment, the function provided by the unit other than the maintenance unit includes the masking device for switching the irradiating state and the non-irradiating state of the ultraviolet rays, and when the head maintenance is performed, covers the ultraviolet light source of the ultraviolet irradiating device to switch into the non-irradiating state of the ultraviolet rays. Thus, with a movement of the masking device, the switching between the irradiating state and the non-irradiating state can be attained with simple structure more rapidly and in good timing.

Assuming that the function of switching between the irradiating state and the non-irradiating state of the ultraviolet rays is performed by turning on and off the ultraviolet light sources, if the ultraviolet light sources are once turned off, it needs to wait for a certain elapsing time before turning on again, or it takes time for the ultraviolet rays to reach a predetermined amount of irradiation after turning on. On the other hand, if this switching function for the irradiating state and the non-irradiating state is performed by the movement of the masking device with the ultraviolet light sources kept lighting, above problem can be avoided, and the switching between the irradiating state and the non-irradiating state can be attained more quickly at necessitated timing.

Further, compared with the switching method for the irradiating state and the non-irradiating state by turning on and off the ultraviolet light sources, since the ultraviolet light sources are always lit, deterioration of the ultraviolet light sources can be reduced, leading to longer life of the ultraviolet light sources and a resultant lower cost.

Further, in the first embodiment, the masking device is provided by the ultraviolet irradiating device, to thereby compactly house the masking device.

Therefore, space can be effectively saved and the masking device can be disposed at the position the ultraviolet irradiating device is reliably masked.

As for the ultraviolet light source in the ultraviolet irradiating device in the first embodiment, any one of high-pressure mercury lamp, metal halide lamp, hot cathode tube, cold cathode tube, LED, Microwave lamp, eximer lamp, and low-pressure mercury lamp can be employed, and these components also achieve the same effects as described above.

Additionally, the ink jetted from the recording head is a cationic curable ink in the first embodiment. The cationic curable ink is more sensitive to ultraviolet rays than radical curable ink, and therefore easily affected by the ultraviolet rays when adhering to a maintenance unit. But the head maintenance is performed with the ultraviolet masking state of the maintenance unit released after bringing the ultraviolet rays irradiated from the ultraviolet irradiating device into the non-irradiating state. Therefore, even cationic curable ink can avoid the increase of viscosity or its curing.

Second Embodiment

Figure 8:
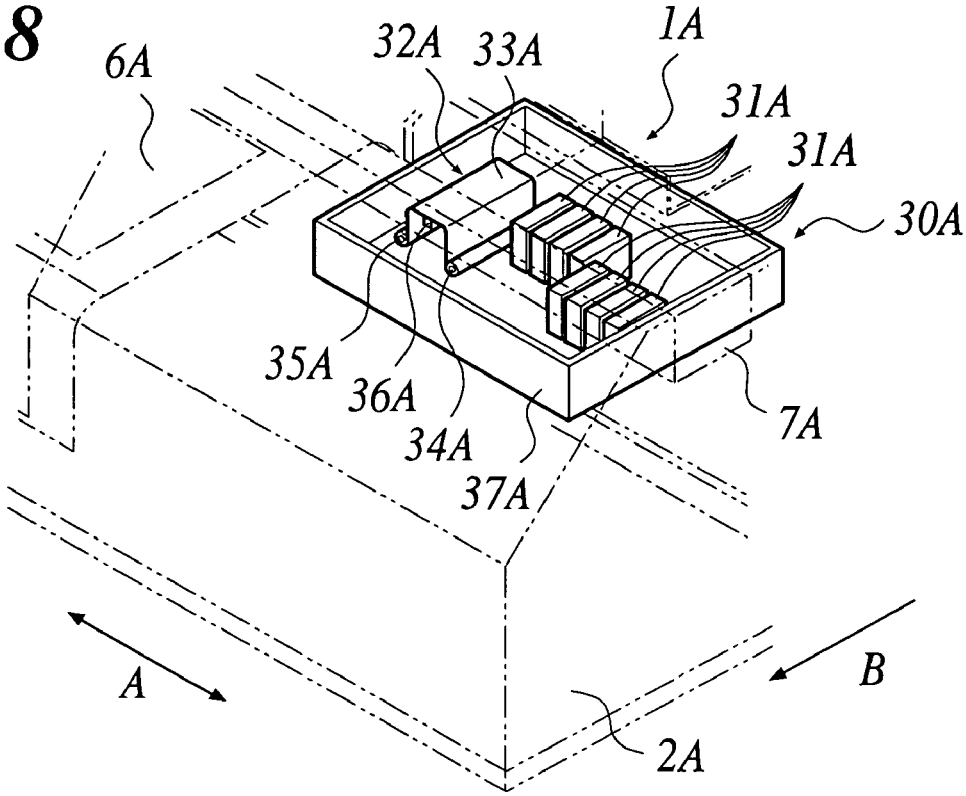
FIG. 8 is a perspective view showing another example of the maintenance unit provided in the ink jet printer according to the present invention in a state at the time of image forming.
Figure 9:
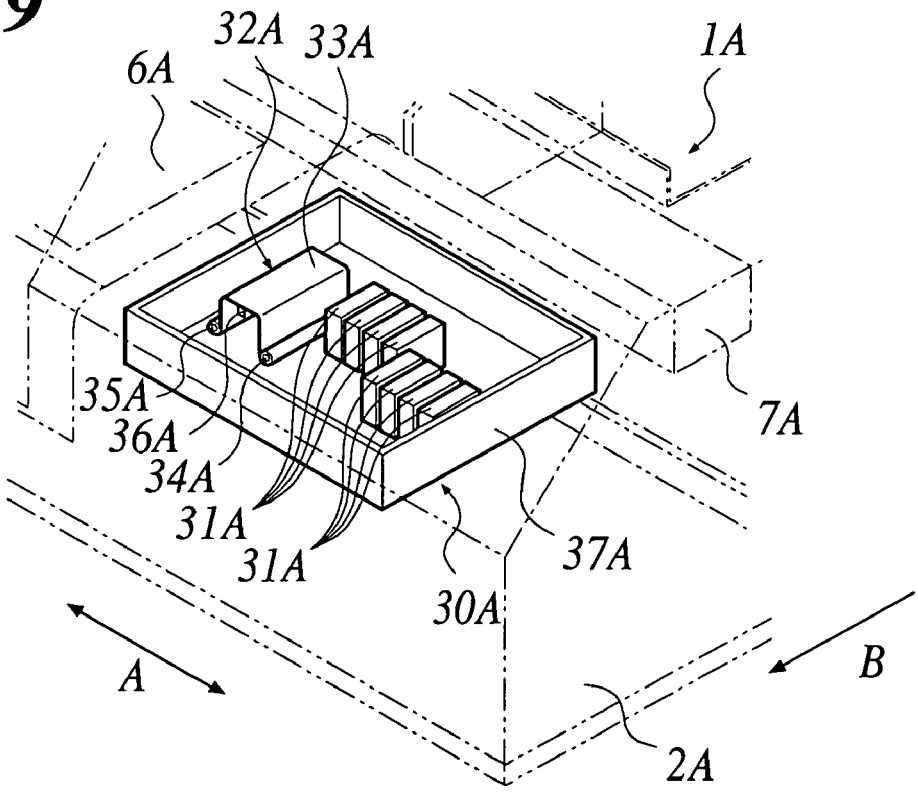
FIG. 9 is a perspective view showing the maintenance unit of FIG. 8 in a state at the time of head maintenance.

A second embodiment of an ink jet printer shown in FIGS. 8 and 9 is the same serial type one as in the first embodiment. This ink jet printer 1A differs from the ink jet printer 1 of the first embodiment shown in FIG. 1 in that a maintenance unit 30A does not have a masking blade, and is movable between a maintenance region for performing the head maintenance within a carriage scanning area and an evacuating region outside of the carriage scanning area, where the ultraviolet irradiating device does not irradiate ultraviolet rays on the maintenance unit 30A. The ink jet printer 1A has, as in the first embodiment, a housing 2A, the legs, the reinforcing members, the casters, a platen 6A, a guide member 7A, the carriage, the recording heads, the ultraviolet irradiating device, the ink tanks, and the feeding mechanism for feeding the recording medium in the feeding direction B. These elements are the same as of the ink jet printer 1 of the first embodiment and the detailed explanation is omitted.

The maintenance unit 30A will be explained below.

Referring to FIGS. 8 and 9, the maintenance unit 30A has an absorbing device having absorbing caps 31A, and a wiping device 32A, and the entire unit is accommodated in a case 37A for masking ultraviolet rays. Besides, as well as the first embodiment, for example, a partial member of an absorbing pump or the like of the absorbing device may not be housed in the case 37A, but provided outside the case. The wiping device 32A has an ink absorbing member 33A, a first roll shaft 34A, a second roll shaft 35A, a heater 36A, a roll shaft drive mechanism not shown, and the like.

The maintenance unit 30A of the second embodiment is also provided with a maintenance unit moving mechanism not shown, for moving the maintenance unit 30A front and rear, and up and down.

The entire maintenance unit 30A including the absorbing device having the absorbing caps 31A and the wiping device 32A of the second embodiment is movable front and rear, namely in the feeding direction B by the maintenance unit moving mechanism, and can be moved between a maintenance region (front side) for performing the head maintenance within a carriage scanning area and an evacuating region (rear side) outside the carriage scanning area, where the ultraviolet irradiating device does not irradiate ultraviolet rays thereon. Here, the maintenance unit 30A is in the masking state in which the ultraviolet rays are masked when the maintenance unit 30A is moved to the evacuating region, and the maintenance unit 30A is in the non-irradiating state in which the ultraviolet rays are not masked when the maintenance unit 30A is moved to the maintenance region.

When an image is formed, the maintenance unit 30A is positioned at the evacuating region on the upstream side (rear side) of the feeding direction B which is in the outside of the carriage scanning area as shown in FIG. 8 so as to prevent the inside such as the absorbing device having the absorbing caps 31A and the wiping device 32A of the maintenance unit 30A from exposure to the ultraviolet rays by masking the ultraviolet rays irradiated from the ultraviolet irradiating device. At this time, the maintenance unit 30A is in the head maintenance disabling state in which the head maintenance cannot be performed because the maintenance unit 30A positions at the evacuating region.

When the head maintenance is performed, the maintenance unit 30A moves to the maintenance region on the downstream side (front side) of the feeding direction B which is within the carriage scanning area with respect to the evacuating region as shown in FIG. 9. The maintenance unit 30A is in the head maintenance enabling state capable of performing the head maintenance. At this time, the ultraviolet rays are in the non-masking state.

A description will be given of the operations of the ink jet printer 1A arranged as described above. Here, the same operations as in the first embodiment will be omitted.

The control of the maintenance unit 30A at the time of image forming will be first explained.

When an image is formed, the control section moves the maintenance unit 30A to the evacuating region where the ultraviolet irradiating device does not irradiate ultraviolet rays thereon, as shown in FIG. 8, and brings the maintenance unit 30A into the masking state which becomes the head maintenance disabling state. With this structure, even if the carriage enters the maintenance region when an image is formed, the inside such as the absorbing device having the absorbing caps 31A and the wiping device 32A of the maintenance unit 30A is protected from exposure to the ultraviolet rays irradiated from the ultraviolet irradiating device.

Figure 10:
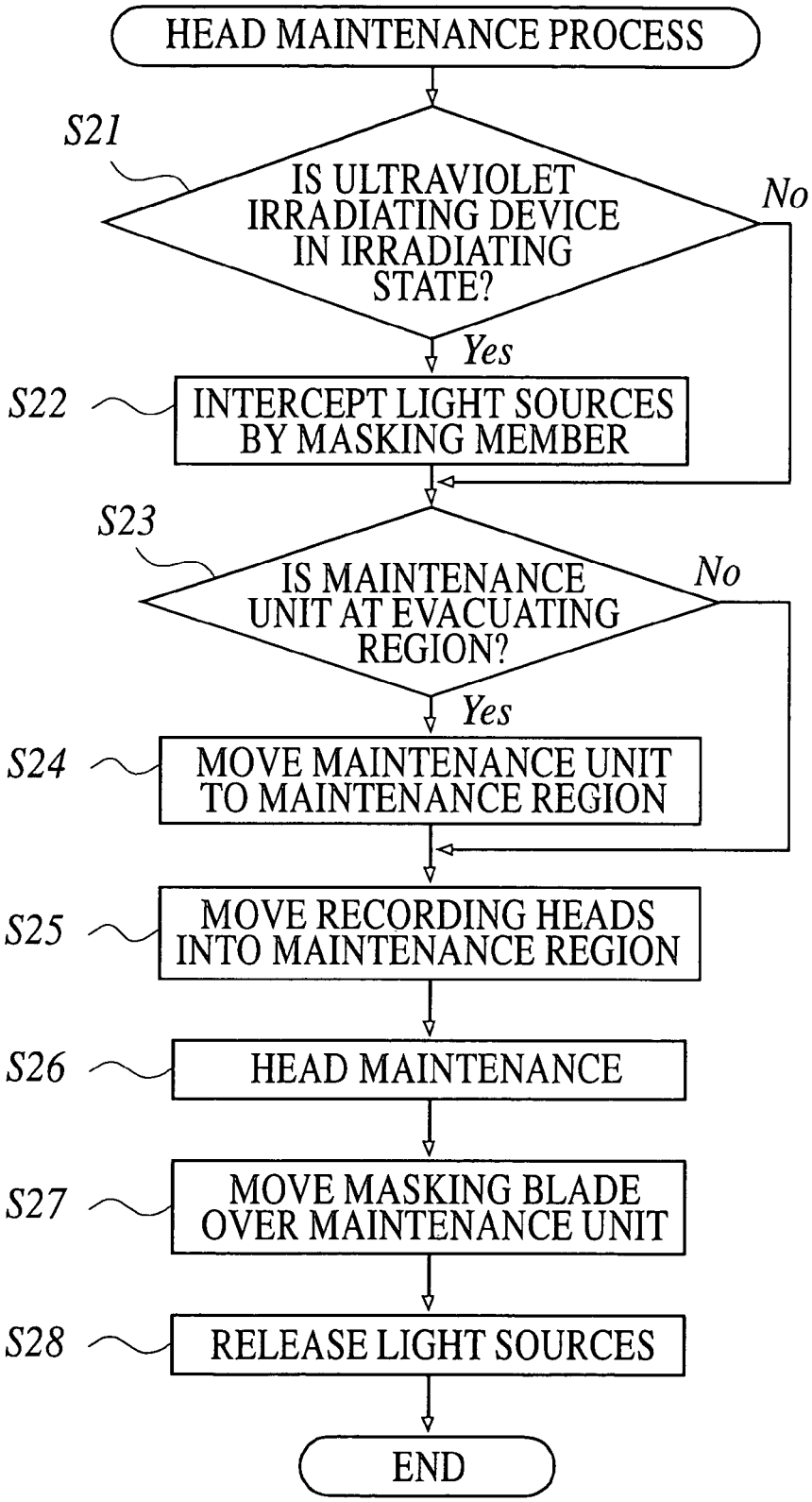
FIG. 10 is a flow chart showing another example of head maintenance process in the ink jet printer according to the present invention.

Next, the control when the head maintenance is performed, that is, a head maintenance process will be explained referring to a flowchart of FIG. 10.

Initially, when the head maintenance is performed, the control section determines whether the ultraviolet irradiating device, when the carriage is in the recording position or in the home position region, is in the irradiating state or in the non-irradiating state, that is, whether the plate member of the masking device that is also the masking function provided by the unit other than the maintenance unit 30A does not intercept the ultraviolet rays irradiated from the ultraviolet light source without covering the opening of the cover member, or intercepts the ultraviolet rays by covering the opening of the cover member (step S21). If the non-irradiating state of the ultraviolet rays irradiated from the ultraviolet irradiating device to the maintenance unit 30A is secured while the masking device is intercepting the ultraviolet rays, the ultraviolet irradiating device is kept as is.

Contrary, if the masking device does not intercept the ultraviolet rays and the ultraviolet irradiating device is in the irradiating state, the plate member of the masking device is moved to the position where the masking member covers the opening of the cover member, and intercepts the ultraviolet rays irradiated from the ultraviolet light source for switching the ultraviolet irradiating device into the non-irradiating state (step S22). This process securely brings the maintenance unit 30A into the state of being protected from irradiation of the ultraviolet rays in the masking device that is also the masking function provided by the unit other than the maintenance unit 30A.

Next, the control section determines whether the maintenance unit 30A is itself in the masking state or not, that is, the entire maintenance unit 30A including the absorbing device having the absorbing caps 31A, the wiping device 32A and the like positions at the evacuating region on which the ultraviolet irradiating device does not irradiate the ultraviolet rays and which is in the outside of the carriage scanning area, and also in the head maintenance disabling state, or the maintenance unit 30A is within the carriage scanning area and positions at the maintenance region not to mask the ultraviolet rays irradiated from the ultraviolet irradiating device, and also in the head maintenance enabling state (step S23). If the maintenance unit 30A positions at the maintenance area and is in the head maintenance enabling state as shown in FIG. 9, the maintenance unit 30A is kept as is.

Contrary, as shown in FIG. 8, if the maintenance unit 30A is at the evacuating region and in the head maintenance disabling state, the maintenance unit 30A is moved to the maintenance region for bringing the maintenance unit 30A into the non-irradiating state which becomes the head maintenance enabling state (step S24).

Then, the carriage having the recording heads and the ultraviolet irradiating devices in the non-irradiating state thereon is moved to the maintenance region (step S25), and the head maintenance is performed (step S26). The head maintenance operations are the same as those in the first embodiment, and the description thereof is omitted.

Subsequently, the maintenance unit 30A is moved to the evacuating region to bring into the masking state which becomes the maintenance disabling state (step S27). Then, the plate member of the masking device is moved to the position which is in the outside of the irradiating surface of the ultraviolet irradiating device and which does not cover the irradiating surface for releasing the ultraviolet light sources, thereby setting the ultraviolet irradiating device in the ultraviolet irradiating state, and allowing the ink jet printer 1A to form an image (step S28).

As described above, in the ink jet printer according to the second embodiment, the maintenance unit is switchable between the maintenance region in which the head maintenance is performed within the carriage scanning area, and the evacuating region in which the maintenance unit is located outside the carriage scanning area so as not to be exposed to the ultraviolet rays from the ultraviolet irradiating device. The control section is provided for controlling the maintenance unit so as to be converted to the masking state which becomes the head maintenance disabling state when the image is formed, by moving the maintenance unit to the evacuating region, and for controlling the maintenance unit so as to be converted to the non-masking state which becomes the head maintenance enabling state, by moving the maintenance unit into the maintenance region after securing the non-irradiating state in which the ultraviolet rays irradiated from the ultraviolet irradiating device are not irradiated on the maintenance unit, by the function provided by the unit other than the maintenance unit when the head maintenance is performed. Thus, the maintenance unit is more securely protected from the ultraviolet rays irradiated from the ultraviolet irradiating device.

Therefore, more reliable and excellent head maintenance is performed. Especially, the overall maintenance unit is moved to thereby mask over the component parts such as the absorbing device and the wiping device constructing the maintenance unit when the maintenance unit is moved to the evacuating region and to prevent various defects such as reduction of closing performance of the absorbing cap of the absorbing device due to deterioration of the absorbing device and curing of the ink of the absorbing device and reduction of wiping performance for ink due to deterioration of the wiping device and curing of the ink of the wiping device. Further, when forming the image, the maintenance unit is positioned at the evacuating region far away from the ultraviolet irradiating device to thereby prevent the maintenance unit from the heat emitted from the ultraviolet light source.

Further, it will be however, be evident that various modifications and changes may be made to each of the embodiments without departing from the scope of the present invention.

The entire disclosure of Japanese Patent Application No. Tokugan 2003-114590 filed on Apr. 18, 2003 and Japanese Patent Application No. Tokugan 2004-71250 filed on Mar. 12, 2004 including specification, claims, drawings and summary are incorporated herein by reference in its entirety.

What is claimed is:

1. An ink jet printer comprising:

a recording head for jetting ultraviolet curable ink on a recording medium;

an ultraviolet irradiating device for curing the ultraviolet curable ink jetted on the recording medium with irradiation of the ultraviolet rays;

a carriage for scanning to form an image on the recording medium, the carriage including the recording head and the ultraviolet irradiating device;

a maintenance unit for performing maintenance on the recording head at a predetermined timing, the maintenance unit being switchable between a masking state in which the ultraviolet rays are masked and a non-masking state in which the ultraviolet rays are not masked, the masking state being a head maintenance disabling state in which head maintenance is not allowed, and the non-masking state being a head maintenance enabling state in which the head maintenance is allowed; and a control section for controlling the maintenance unit so as to be converted to the masking state which is the head maintenance disabling state when an image is formed, and for controlling the maintenance unit so as to be converted to the non-masking state which is the head maintenance enabling state after securing a non-irradiating state in which the ultraviolet rays irradiated from the ultraviolet irradiating device are not irradiated on the maintenance unit, by a function provided by a unit other than the maintenance unit, when the head maintenance is performed.

2. The ink jet printer of claim 1, wherein the maintenance unit comprises a masking blade at a side facing the ultraviolet irradiating device, and the masking blade is movable between a masking position in which the ultraviolet rays irradiated from the ultraviolet irradiating device are masked and an evacuated position in which the ultraviolet rays are not masked, and wherein the control section controls the maintenance unit so as to be converted to the masking state which is the head maintenance disabling state when the image is formed, by moving the masking blade to the masking position, and controls the maintenance unit so as to be converted to the non-masking state which is the head maintenance enabling state, by moving the masking blade to the evacuated position after securing the non-irradiating state, by the function provided by the unit other than the maintenance unit, when the head maintenance is performed.

3. The ink jet printer of claim 2, wherein the maintenance unit is movable between a maintenance region in which the head maintenance is performed within a scanning area of the carriage, and an evacuating region in which the maintenance unit is located outside the scanning area of the carriage so as not to be exposed to the ultraviolet rays irradiated from the ultraviolet irradiating device, and wherein the control section controls the maintenance unit so as to be converted to the masking state which is the head maintenance disabling state when the image is formed, by moving the maintenance unit to the evacuating region, and controls the maintenance unit so as to be converted to the non-masking state which is the head maintenance enabling state, by moving the maintenance unit into the maintenance region after securing the non-irradiating state, by the function provided by the unit other than the maintenance unit, when the head maintenance is performed.

4. The ink jet printer of claim 3, wherein the unit other than the maintenance unit includes a masking device for switching between an irradiating state and the non-irradiating state of the ultraviolet rays.

5. The ink jet printer of claim 4, wherein the masking device is provided by the ultraviolet irradiating device.

6. The ink jet printer of claim 2, wherein the unit other than the maintenance unit includes a masking device for switching between an irradiating state and the non-irradiating state of the ultraviolet rays.

7. The ink jet printer of claim 6, wherein the masking device is provided by the ultraviolet irradiating device.

8. The ink jet printer of claim 2, wherein an ultraviolet light source in the ultraviolet irradiating device includes any one of a high-pressure mercury lamp, a metal halide lamp, a hot cathode tube, a cold cathode tube, an LED, a Microwave lamp, an excimer lamp, and a low-pressure mercury lamp.

9. The ink jet printer of claim 2, wherein the ultraviolet curable ink jetted from the recording head is a cationic curable ink.

10. The ink jet printer of claim 1, wherein the maintenance unit is movable between a maintenance region in which the head maintenance is performed within a scanning area of the carriage, and an evacuating region in which the maintenance unit is located outside the scanning area of the carriage so as not to be exposed to the ultraviolet rays irradiated from the ultraviolet irradiating device, and wherein the control section controls the maintenance unit so as to be converted to the masking state which is the head maintenance disabling state when the image is formed, by moving the maintenance unit to the evacuating region, and controls the maintenance unit so as to be converted to the non-masking state which is the head maintenance enabling state, by moving the maintenance unit into the maintenance region after securing the non-irradiating state by the function provided by the unit other than the maintenance unit, when the head maintenance is performed.

11. The ink jet printer of claim 10, wherein the unit other than the maintenance unit includes a masking device for switching between an irradiating state and the non-irradiating state of the ultraviolet rays.

12. The ink jet printer of claim 11, wherein the masking device is provided by the ultraviolet irradiating device.

13. The ink jet printer of claim 10, wherein an ultraviolet light source in the ultraviolet irradiating device includes any one of a high-pressure mercury lamp, a metal halide lamp, a hot cathode tube, a cold cathode tube, an LED, a Microwave lamp, an excimer lamp, and a low-pressure mercury lamp.

14. The ink jet printer of claim 10, wherein the ultraviolet curable ink jetted from the recording head is a cationic curable ink.

15. The ink jet printer of claim 1, wherein the unit other than the maintenance unit includes a masking device for switching between an irradiating state and the non-irradiating state of the ultraviolet rays.

16. The ink jet printer of claim 15, wherein the masking device is provided by the ultraviolet irradiating device.

17. The ink jet printer of claim 16, wherein an ultraviolet light source in the ultraviolet irradiating device includes any one of a high-pressure mercury lamp, a metal halide lamp, a hot cathode tube, a cold cathode tube, an LED, a Microwave lamp, an excimer lamp, and a low-pressure mercury lamp.

18. The ink jet printer of claim 15, wherein an ultraviolet light source in the ultraviolet irradiating device includes any one of a high-pressure mercury lamp, a metal halide lamp, a hot cathode tube, a cold cathode tube, an LED, a Microwave lamp, an excimer lamp, and a low-pressure mercury lamp.

19. The ink jet printer of claim 1, wherein an ultraviolet light source in the ultraviolet irradiating device includes any one of a high-pressure mercury lamp, a metal halide lamp, a hot cathode tube, a cold cathode tube, an LED, a Microwave lamp, an excimer lamp, and a low-pressure mercury lamp.

20. The ink jet printer of claim 1, wherein the ultraviolet curable ink jetted from the recording head is a cationic curable ink.

* * * * *